United States Patent [19]

Frommeld

[11] 4,273,850

[45] Jun. 16, 1981

[54] TWO-COMPONENT DIAZOTYPE MATERIAL

[75] Inventor: Hans-Dieter Frommeld, Wiesbaden, Fed. Rep. of Germany

[73] Assignee: Hoechst Aktiengesellschaft, Fed. Rep. of Germany

[21] Appl. No.: 124,575

[22] Filed: Feb. 25, 1980

[30] Foreign Application Priority Data

Feb. 26, 1979 [DE] Fed. Rep. of Germany ..... 2907446

[51] Int. Cl.[3] ..... G03C 1/58; G03C 1/54

[52] U.S. Cl. ..... 430/173; 430/148; 430/150; 430/180; 430/187

[58] Field of Search ..... 430/180, 187, 173, 148, 430/150

[56] References Cited

U.S. PATENT DOCUMENTS

| | | | |
|---|---|---|---|
| 2,286,701 | 6/1942 | Werner | 430/187 |
| 2,537,098 | 1/1951 | Slifkin et al. | 430/180 |
| 2,970,909 | 2/1951 | Slimowicz | 430/180 |
| 3,272,627 | 9/1966 | Sus et al. | 430/180 |
| 3,406,071 | 10/1968 | Sus et al. | 430/180 |
| 3,645,741 | 2/1972 | Shiraishi et al. | 430/148 |
| 3,664,840 | 5/1972 | Saito et al. | 430/180 |
| 3,761,263 | 9/1973 | Fleming et al. | 430/180 |

OTHER PUBLICATIONS

Landau, R., "Fascicules 9217,", Dist. by Andrews Paper & Chem. Co., 1962, pp. 3 and 49.

*Primary Examiner*—Charles L. Bowers, Jr.
*Attorney, Agent, or Firm*—James E. Bryan

[57] ABSTRACT

This invention relates to an improvement in a two-component diazotype material, composed of a support and of a light-sensitive layer applied to the support, the layer containing at least one benzene diazonium salt as the light-sensitive component and at least one coupler, the improvement comprising the combination of at least one 2,5-dialkoxy-4-mercaptobenzene diazonium salt and at least one compound of the general formula

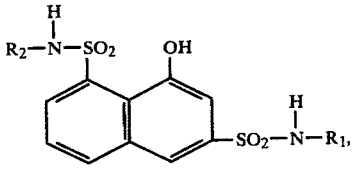

in which $R_1$ and $R_2$ are identical or different and denote hydrogen or alkyl, alkenyl, aralkyl, aryl or cycloalkyl groups, which can be further substituted.

8 Claims, No Drawings

TWO-COMPONENT DIAZOTYPE MATERIAL

The present invention relates to a two-component diazotype material composed of a support and of a light-sensitive layer which is applied thereto, the layer containing at least one light-sensitive diazonium salt and one coupler. Many compounds which couple to give a blue dye already have been described for use in two-component diazotype materials. Most of these descriptions relate to 2-hydroxyl-naphthalene derivatives, for example 2-hydroxy-naphthalene-3-carboxylic acid amides, which, in combination with p-amino-benzene diazonium salts, are industrially used for blue formulations and, in combination with other couplers, are industrially used for black formulations. The Landau Report, 9–17, page 49 (1962), also discloses 1-hydroxynaphthalene-3,8-sulfonic acid amides as blue couplers for which, however, either no technical data are given, or the data given are of a type from which it is not possible to draw conclusions as to a particular suitability. Thus, they are described as being light-stable, slowly coupling to give a pale blue color or, in combination with a special p-amino-benzene diazonium salt (blue salt), to give a pleasing blue color, and as being strongly basic.

In addition to having many advantages, p-aminobenzene diazonium salts also have some serious disadvantages. Thus, in filed documents, the background of the copies discolors with time, i.e., it yellows. When the pH shifts, for example due to acid vapors, the dyes lose their contrast and change, in a manner similar to pH indicator dyes, to wine-red to light yellow color shades. Precisely in the case of the widely used, light-sensitive p-amino-benzene diazonium salts, the heat stability is also limited, and this leads to contrast losses during the storage of unexposed material.

It is also known (U.S. Pat. No. 2,286,701) to use p-mercapto-2,5-dialkoxy-benzene diazonium salts, mainly for one-component diazotype materials. Due to their relatively high coupling activity and the disadvantageous storage life connected therewith, they have been regarded for a long time as unsuitable for two-component materials. Recently, two-component diazotype materials with p-mercapto-2,5-dialkoxybenzene diazonium salts have been disclosed which, with phenols as yellow couplers and resorcylic acid or resorcylic acid amides as red-brown couplers, lead to interesting, contrast-rich brown-line prints with a light copy background which is particularly stable in filed documents. Hitherto, however, it was not possible also to develop corresponding blue or black-line prints. With p-mercapto-benzene diazonium salts, the conventional blue couplers form only red-violet to violet-blue dyes and do not form the neutral blue color shades known from p-aminobenzene diazonium salts. The high coupling activity and the red shift of the dyes are here typical of p-mercapto-benzene diazonium salts.

Black formulations are obtained in diazotype copying by mixing two or more couplers (Kosar, Light-Sensitive Systems, Wiley & Sons, New York, 1965, page 303). For this purpose, it is as a rule necessary to employ a slightly reddish-tinged blue coupler, the coupling rate of which is of a similar order of magnitude to that of the admixed yellow couplers and brown couplers.

It has been found that none of the known 2-hydroxynaphthalene derivatives is suitable for black formulations with p-mercaptobenzene diazonium salts. For example, the widely used 2-hydroxy-naphthalene-3-carboxylic acid amides couple too rapidly and form reddish-tinged dyes. 1-Hydroxy-naphthalene derivatives, also known as couplers, for example those from U.S. Pat. No. 2,970,909 couple with p-mercaptobenzene diazonium salts to give wine-red dyes. Finally, U.S. Pat. No. 3,406,071, discloses 1-hydroxy-4-alkylnaphthalene-8-sulfonamide derivatives as contrast-rich couplers. These exhibit such a high coupling activity, however, that it is not possible to produce stable diazotype materials which can be stored, using p-mercaptobenzene diazonium salts. In U.S. Pat. No. 3,645,741 1-hydroxy-naphthalene-3-sulfonic acid-8-sulfonic acid amide derivatives are described as blue couplers, preferably in combination with p-aminobenzene diazonium salts. In combination with p-mercaptobenzene diazonium salts, these derivatives also form reddish-tinged, violet dyes which cannot be used either for blue formulations or for black formulations. U.S. Pat. No. 3,272,627 discloses 1-hydroxy-naphthalene-8-sulfonic acid amides, which can be further substituted, as alkali donors in diazotype materials. There is no suggestion at all that they could be suitable as couplers. Coating solutions containing the 1-hydroxy-naphthalene-4,8-disulfonic acid diamides described in the latter Patent rapidly become dark upon standing and are not very useful. Similar comments apply to the 1-hydroxy-naphthalene-4-sulfonic acid 8-sulfonamides described in German Offenlegungsshcrift No. 1,772,697.

The object of the present invention is to provide blue couplers which have a matching coupling activity and which, with p-mercaptobenzene diazonium salts, form neutral-blue dyes which, due to these properties, are also suitable for black formulations.

The present invention thus relates to a two-component diazotype material, composed of a support and of a light-sensitive layer which is applied thereto and which layer contains at least one benzene diazonium salt as the light-sensitive component and at least one coupler, which comprises the combination of at least one 2,5-dialkoxy-4-mercaptobenzene diazonium salt and at least one compound of the general formula

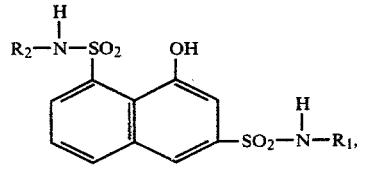

in which $R_1$ and $R_2$ are identical or different and denote hydrogen or alkyl, alkenyl, aralkyl, aryl or cycloalkyl groups, which can be further substituted.

The benzene diazonium salt employed preferably is a 2,5-dialkoxy-4-arylmercaptobenzene diazonium salt, in particular a 2,5-diethoxy-4-p-tolylmercaptobenzene diazonium salt, which is used in the form of its tetrafluoborate, sulfate or chloride as a double salt, for example with zinc chloride.

In the general formula, $R_1$ and $R_2$ preferably denote alkyl or alkenyl, aryl, aralkyl or cycloalkyl groups, which have up to 10 carbon atoms and which can be substituted by alkyl or alkoxy groups having up to 4 carbon atoms, by carboxyl, by acyl having up to 3 carbon atoms, by phenoxy, by halogen, in particular chlorine or bromine, by hydroxyl or by optionally alkylsubstituted amine.

Compounds according to the general formula in which $R_1$ represents optionally substituted aryl and $R_2$ represents optionally substituted alkyl, alkenyl, aralkyl or cycloalkyl have proved to be very particularly suitable.

Surprisingly, it has been found that precisely the 1-hydroxy-naphthalene-3,8-disulfonic acid amides according to the invention yield neutral-blue dyes in combination with the p-mercaptobenzene diazonium salts. Moreover, it has been found that the coupling rate of these compounds is of a similar order of magnitude to that of phenol derivatives or resorcylic acid derivatives. They thus can be advantageously used in combination with these couplers to give black formulations.

The synthesis of these compounds is effected via naphthosultone-3-sulfochloride, which is described in Friedländer, Fortschritte der Teerfarbenfabrikation (Advances in the Manufacture of Coal Tar Dyes), Berlin 1923, Part 13, page 1108. This compound reacts with ammonia or amines to give 1-hydroxy-naphthalene-3,8-disulfonic acid amides. Because, however, the sulfonic acid chloride group in the 3-position is more reactive than the sultone grouping, it is also possible to carry out successive reactions with two different amines. For example, at room temperature, naphthosultone-3-sulfochloride reacts quantitatively with excess aniline to give naphthosultone-3-sulfonic acid anilide, and the latter in turn reacts to room temperature rapidly and quantitatively with methylamine to give 1-hydroxy-naphthalene-3-sulfonic acid anilide-8-sulfonic acid methylamide.

The solubility in aqueous or organic solvents strongly depends upon the nature of the groups $R_1$ and $R_2$. The groups also have a certain influence on the coupling rate and the color shade. Thus, for example, the 1-hydroxy-naphthalene-3,8-di-(alkyl, aralkyl, alkenyl or cycloalkyl)-sulfonamides couple somewhat more rapidly and are more reddish-tinged than the 1-hydroxy-naphthalene-3-arylsulfonamido-8-alkylsulfonamides. The 1-hydroxy-naphthalene-3,8-di-(N-arylsulfonamides) are even more greenish-tinged. The latter are less light-stable and have some tendency to yellowing in light. 1-Hydroxy-naphthalene-3-arylsulfonamido-8-alkylsulfonamides, such as 1-hydroxy-naphthalene-3-p-tolylsulfonamido-8-n-butyl-sulfonamide, are particularly suitable for black formulations.

Amines which are suitable for the reaction in addition to ammonia are alkylamines, for example methylamines, ethylamine, n- or iso-propylamine, butylamine, 2-ethylhexylamine or decylamine, alkenylamines, for example allylamine, aralkylamines, for example benzylamine, phenethylamine or phenylbutylamine, cycloalkylamines, for example cyclohexylamine, cyclooctylamine or 4-t-butylcyclohexylamine, and also aniline derivatives which can be substituted by amine, alkyl, alkoxy or halogen, for example toluidine, xylidine, difluoroaniline, tribromoaniline, 4-morpholino-2,5-dimethoxyaniline or aminoacetophenone. The aliphatic groups also can be substituted, without any disadvantage. Available inexpensive industrial amines are, for example, ethanolamine, hydroxypropylamine, diethylaminoethylamine, morpholinopropylamine, pyrrolidinoethylamine, 4-amino-(N-methylpyrrolidine), piperidinobutylamine, butoxypropylamine, phenoxyethylamine or aminopropionic acid.

Examples of compounds according to the invention are given in the list of formulae below.

The support used can be, for example, paper or film, the diazotype layer preferably being dispersed in a lacquer layer composed of a cellulose ester, for example cellulose acetobutyrate.

For black formulations, simple phenol derivatives, for example 2-hydroxydiphenyl, 2,2'-dihydroxydiphenyl, 2-hydroxyethoxyphenol, 2-hydroxybenzoic acid amide or 3,6-dimethylphenol, additionally can be used as a Mannich base, or resorcylic acid and its derivatives, for example 2,4-dihydroxybenzoic acid, 2,4-dihydroxybenzoic acid amide, 2,4-dihydroxybenzoic acid ethanolamide or ethyl 2,4-dihydroxybenzoate, can be used.

The examples which follow serve to explain the invention in more detail, without restricting the scope of the invention thereto.

EXAMPLE 1

In the form of their double salts with zinc chloride, (a) 0.64 g of p-diethylaminobenzene diazonium chloride
(b) 0.80 g of 3-methyl-4-pyrrolidinobenzene diazonium chloride
(c) 0.88 g of 2,5-dibutoxy-4-morpholino-benzene diazonium chloride
(d) 0.80 g of 2,5-diethoxy-4-morpholino-benzene diazonium chloride
(e) 0.56 g of 2,5-diethoxy-4-p-tolylmercapto-benzene diazonium chloride
(f) 0.56 g of 2,5-diethoxy-4-carboxyethylmercapto-benzene diazonium chloride, and
(g) 0.52 g of 2,5-dimethoxy-4-p-tolylmercapto-benzene diazonium chloride are each dissolved in 100 ml of a solution composed of
70 g of cellulose acetopropionate
680 ml of acetone
120 ml of methanol
120 ml of methylglycol
8 g of tartaric acid
2.4 g of boric acid, and
8 g of 1-hydroxy-napthalene-3-sulfonic acid p-toluidide-8-sulfonic acid N-methylamide (formula 14).

The solutions are applied to polyester films at a wet weight of about 100 g/m$^2$ and are dried. The quantity of diazo compound is such that the contrast is approximately equal in the different samples. Using a TD-205 Macbeth Quantalog Densitometer with a 106 Wratten filter, the density of fresh material (I) and of material aged for two, four and seven (II, III, IV) days in an accelerated storage test at 60° C. (Hot Box) is measured after the development with ammonia, which follows exposure under an original. The values entered in the table below show that the fall in density in the case of the p-mercaptobenzene diazonium salts is very much smaller than in the case of the p-aminobenzene diazonium salts.

| | Optical density | Fall in optical density | | |
|---|---|---|---|---|
| | (I) | II | III | IV |
| (a) | 1.54 | 16% | 26% | 38% |
| (b) | 1.55 | 44% | 67% | 79% |
| (c) | 1.54 | 19% | 34% | 46% |
| (d) | 1.56 | 21% | 34% | 52% |
| (e) | 1.56 | 4% | 8% | 9% |
| (f) | 1.50 | 5% | 9% | 11% |
| (g) | 1.56 | 5% | 9% | 10% |

EXAMPLE 2

0.4 g of the following coupler substances:

(a) 2-hydroxy-3-naphthoic acid toluidide (Naphthol AS-D)
(b) 2-hydroxy-3-naphthoic acid N-morpholinopropylamide (HCl salt)
(c) 1-hydroxy-naphthalene-3-sulfonic acid ethanolamide (corresponding to U.S. Pat. No. 2,970,909)
(d) 1-hydroxy-naphthalene-3-sulfonic acid-8-sulfonic acid amide (corresponding to U.S. Pat. No. 3,645,741)
(e) 1-hydroxy-naphthalene-3-sulfonic acid-8-sulfonic acid n-butylamide (corresponding to U.S. Pat. No. 3,645,741)
(f) 1-hydroxy-naphthalene-3,8-di-(sulfonic acid n-butylamide) (formula 4)
(g) 1-hydroxy-naphthalene-3-sulfonic acid anilide-8-sulfonic acid cyclohexylamide (formula 8)
(h) 1-hydroxy-naphthalene-3,8-di-(sulfonic acid anilide) (formula 5) and
(i) 1-hydroxy-naphthalene-3-sulfonic acid anilide-8-sulfonic acid γ-methoxypropylamide (formula 10)

is dissolved in each case in 100 ml of a solution composed of 70 g of cellulose acetopropionate
680 ml of acetone
120 ml of methanol
120 ml of methylglycol
8 g of tartaric acid
2.4 g of boric acid
2.4 g of thiourea, and
4 g of 2,5-diethoxy-4-p-tolylmercapto-benzene diazonium chloride (as the double salt with zinc chloride).

The solutions are applied to polyester films at a wet weight of about 100 g per $m^2$ and are dried. The films are then exposed under a step wedge and subsequently developed with ammonia. The color saturation in transmitted light is measured using a D 25/D 28 Hunterlab Color Difference Meter with a halogen lamp. At constant L (depth of color)=44.0, the ratio of blue (−b) and red (+a) is determined by calculation; for pure blue with a small proportion of red, this ratio should be as high as possible. For the tests (a) to (i), the description of the color shade and then the −b/+a value are indicated below.

| | | |
|---|---|---|
| (a) | violet | (1.78) |
| (b) | violet | (1.64) |
| (c) | wine-red | (0.61) |
| (d) | violet | (1.81) |
| (e) | violet | (2.05) |
| (f) | blue with a slight reddish tinge | (3.02) |
| (g) | cobalt blue | (3.49) |
| (h) | Berlin Blue | (4.58) |
| (i) | cobalt blue | (3.23) |

The compounds according to the invention give neutral blue shades as desired. It is to be noted that the replacement of a sulfonic acid amide group by a sulfonic acid anilide group reduces the red proportion in the dye even further.

EXAMPLE 3

A stock solution composed of 80 ml of water
700 ml of isopropanol
60 ml of formic acid
6 g of 2-mercaptobenzthiazole
6 g of 2,4-dihydroxybenzoic acid ethanolamide
16 g of 2,2'-dihydroxydiphenyl
12 g of sulfosalicylic acid
8 g of tartaric acid
2 g of boric acid, and
28 g of 2,5-diethoxy-4-p-tolylmercaptobenzene diazonium chloride as the zinc chloride double salt is prepared and 0.25 g of the following couplers is added to and dissolved in 85 ml of this solution in each case:

(a) 1-hydroxy-naphthalene-4-methyl-8-sulfonic acid N-n-butylamide (corresponding to U.S. Pat. No. 3,406,071)
(b) 1-hydroxy-naphthalene-4-sulfonic acid anilide-8-sulfonic acid N-methylamide (corresponding to U.S. Pat. No. 3,272,627)
(c) 1-hydroxy-naphthalene-4,8-di-(sulfonic acid N-cyclohexylamide)
(d) 1-hydroxy-naphthalene-4-sulfonic acid-8-sulfonic acid N-(β-diethylaminoethylamide) (corresponding to German Offenlegungsschrift No. 1,772,697)
(e) 2-hydroxy-naphthalene-4-sulfonic acid-8-sulfonic acid N-n-butylamide (corresponding to U.S. Pat. No. 3,645,741)
(f) 1-hydroxy-naphthalene-3-sulfonic acid 3',4'di-chloroanilide-8-sulfonic acid N-allylamide (formula 15)
(g) 1-hydroxy-naphthalene-3-sulfonic acid p-anisidide-8-sulfonic acid N-methylamide (formula 13), and
(h) 1-hydroxy-naphthalene-3-sulfonic acid p-toluidide-8-sulfonic acid N-methylamide (formula 14).

One polyester film lacquered with cellulose acetopropionate is in each case coated with the solutions (a) to (h), in the first case immediately (A), in the second case after 6 hours (B) and in the third case after 24 hours (C). Even the fresh solutions a–e are considerably darker than the solutions f–h and correspondingly the background of the copy after imagewise exposure and development is darker from the start in the case of the materials a–e. After standing for 6 hours (B), which is quite usual in practice, useful diazotype films are no longer obtained with the 4,8-derivatives of 1-hydroxy-naphthalene. The background of the copy is distinctly dark.

To express this in figures, the brightness (L value, maximum=100) in reflectance is measured, using a Model D 25 Hunterlab, and the values are assembled in the table which follows:

| Solution | a | b | c | d | e | f | g | h |
|---|---|---|---|---|---|---|---|---|
| for (A) | 82.9 | 85.9 | 85.5 | 83.9 | 86.2 | 88.1 | 88.0 | 88.2 |
| for (B) | 74.2 | 81.5 | 80.4 | 69.2 | 75.6 | 87.8 | 86.7 | 86.9 |
| for (C) | 56.2 | 72.6 | 68.0 | 53.8 | 61.4 | 85.2 | 83.6 | 83.5 |

Similar results also are obtained in storage tests (55° C./35% relative humidity/72 hours) with the materials a–h, which had been prepared with the fresh solution. The background of the material a is blue, that of the materials b–e is blue-gray, and that of the materials f–h is pale gray to light gray.

Only the materials f–h according to the invention are usable as black-line prints with respect to the durability and also with respect to the color shade.

Example 4

Transparent paper lacquered with cellulose acetobutyrate is coated with a solution of the following composition and is dried:

40 ml of water
350 ml of isopropanol
30 ml of glacial acetic acid
10 g of toluenesulfonic acid
1.5 g of 1-hydroxy-naphthalene-3-sulfonic acid p-chloro anilide-8-sulfonic acid n-butylamide (formula 17)
10 g of 2,4-dihydroxybenzoic acid
3 g of pyrocatechol monohydroxyethyl ether
3 g of 2-hydroxybenzoic acid amide, and
14 g of 2,5-diethoxy-4-p-tolylmercapto-benzene diazonium chloride as the zinc chloride double salt.

After imagewise exposure of the finished material under a pencil drawing on transparent paper, a copy with dark lines on a pale gray background is obtained.

Similarly good results are obtained with 1-hydroxy-naphthalene-3-sulfonic acid anilide-8-sulfonic acid morpholino-propylamide (formula 12) or 1-hydroxy-naphthalene-3,8-di-(sulfonic acid n-butylamide) (formula 4).

List of formulae

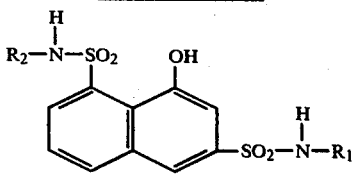

| No. | $R_1$ | $R_2$ | Melting Point (°C.) |
|---|---|---|---|
| 1 | H | H | 248 |
| 2 | $CH_3$ | $CH_3$ | 203 |
| 3 | 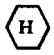 | 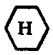 | 194 |
| 4 | n-$C_4H_9$ | n-$C_4H_9$ | 157 |
| 5 | 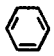 | 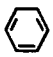 | 212 |
| 6 | 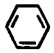 | $CH_3$ | 172 |
| 7 | 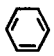 | n-$C_4H_9$ | 158 |
| 8 | 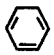 | 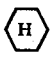 | 201 |
| 9 | 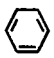 | $CH_2-CH_2-OH$ | 173 |
| 10 | 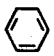 | $CH_2-CH_2-CH_2-O-CH_3$ | 175 |
| 11 | 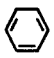 | $CH_2-CH_2-$ | not crystalline |
| 12 | 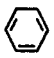 | $CH_2-CH_2-CH_2-N$ 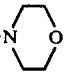 O . HCl | 155 |
| 13 | 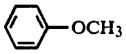 | $CH_3$ | 174 |

-continued

List of formulae

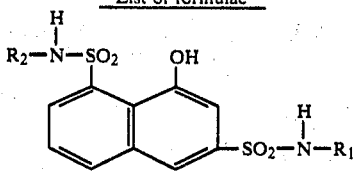

| No. | $R_1$ | $R_2$ | Melting Point (°C.) |
|---|---|---|---|
| 14 | 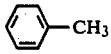 | $CH_3$ | 192 |
| 15 | 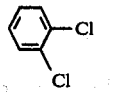 | $CH_2-CH=CH_2$ | 148 |
| 16 | 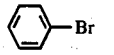 | $CH_2-CH_2-O-$ | not crystalline |
| 17 | 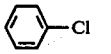 | n-$C_4H_9$ | 168 |

It will be obvious to those skilled in the art that many modifications may be made within the scope of the present invention without departing from the spirit thereof, and the invention includes all such modifications.

What is claimed is:

1. In a two-component diazotype material, composed of a support and of an acid-stabilized light-sensitive layer applied to the support, said layer containing at least one benzene diazonium salt as the light-sensitive component and at least one coupler, the improvement being that said diazonium salt includes at least one 2,5-dialkoxy-4-mercaptobenzene diazonium salt and said coupler includes at least one compound of the general formula

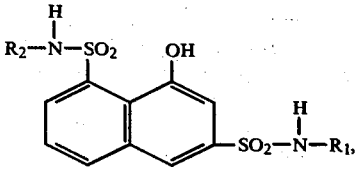

in which $R_1$ and $R_2$ are identical or different and denote hydrogen or alkyl, alkenyl, aralky, aryl or cycloalkyl groups, which can be further substituted.

2. A material as claimed in claim 1 which contains a 2,5-dialkoxy-4-arylmercaptobenzene diazonium salt as the benzene diazonium salt.

3. A material as claimed in claim 1 or 2 which contains a 2,5-diethoxy-4-p-tolylmercaptobenzene diazonium salt as the benzene diazonium salt.

4. A material as claimed in claim 1 wherein $R_1$ and $R_2$ are alkyl or alkenyl, aryl, aralkyl or cycloalkyl groups, which have up to 10 carbon atoms.

5. A material as claimed in claim 1 or 4, wherein $R_1$ and $R_2$ are substituted by alkyl or alkoxy having up to 4 carbon atoms, by carboxyl, by acyl having up to 3 carbon atoms, by phenoxy, by halogen, in particular chlorine or bromine, by hydroxyl or by optionally alkyl-substituted amine.

6. A material as claimed in claim 1 or 4 wherein $R_1$ is optionally substituted aryl and $R_2$ optionally substituted alkyl, alkenyl, aralkyl or cycloalkyl.

7. A material as claimed in claim 6 wherein $R_1$ is a phenyl group and $R_2$ is a butyl group.

8. A material as claimed in claim 1 wherein at least one phenol derivative, resorcylic acid and/or resorcylic acid derivatives are additionally present in the light-sensitive layer.

* * * * *